US008766855B2

(12) United States Patent
Biglarbegian et al.

(10) Patent No.: US 8,766,855 B2
(45) Date of Patent: Jul. 1, 2014

(54) MICROSTRIP-FED SLOT ANTENNA

(75) Inventors: Behzad Biglarbegian, North York (CA); Mohammad-Reza Nezhad-Ahmadi, Waterloo (CA); Safieddin Safavi-Naeini, Waterloo (CA)

(73) Assignee: Semiconductor Components Industries, LLC, Phoenix, AZ (US)

( * ) Notice: Subject to any disclaimer, the term of this patent is extended or adjusted under 35 U.S.C. 154(b) by 204 days.

(21) Appl. No.: 13/177,756

(22) Filed: Jul. 7, 2011

(65) Prior Publication Data

US 2012/0075154 A1 Mar. 29, 2012

Related U.S. Application Data

(60) Provisional application No. 61/362,827, filed on Jul. 9, 2010.

(51) Int. Cl.
*H01Q 13/08* (2006.01)

(52) U.S. Cl.
USPC ..... 343/700 MS; 343/767; 343/770

(58) Field of Classification Search
USPC ..... 343/770, 767
See application file for complete search history.

(56) References Cited

U.S. PATENT DOCUMENTS

| | | | | |
|---|---|---|---|---|
| 5,355,143 | A * | 10/1994 | Zurcher et al. | 343/700 MS |
| 6,522,304 | B2 * | 2/2003 | Ballantine et al. | 343/772 |
| 7,368,311 | B2 * | 5/2008 | Tilmans et al. | 438/48 |
| 2009/0102728 | A1 * | 4/2009 | Gamand | 343/702 |
| 2010/0039190 | A1 * | 2/2010 | Boisbouvier et al. | 333/204 |

* cited by examiner

*Primary Examiner* — Jerome Jackson, Jr.
*Assistant Examiner* — Michael Bouizza
(74) *Attorney, Agent, or Firm* — Noon Intellectual Property Law, P.C.

(57) ABSTRACT

A microstrip-fed antenna is disclosed having a first dielectric substrate and a second dielectric substrate. The second dielectric substrate is disposed on the first dielectric substrate and the first dielectric substrate has a relative permittivity greater than or equal to the second dielectric substrate. The antenna further includes a microstrip line formed in the second dielectric substrate and a metal layer formed in the second dielectric substrate. The metal layer is positioned between the microstrip line and the first dielectric substrate and includes a slot.

20 Claims, 13 Drawing Sheets

MICROSTRIP-FED SLOT ANTENNA

TECHNICAL FIELD

The present disclosure relates to an antenna and more particularly to a miniaturized antenna for wireless communication devices.

BACKGROUND

Use of wireless communication devices has grown exponentially over the years. Devices such as computers and telephones that were once restricted by wires now benefit from advances in wireless technologies. Enabling wireless communication is an antenna that transmits and/or receives electromagnetic waves. Because an antenna is the means by which the communication device transmits and/or receives a signal, the performance of the antenna is an important ingredient in any wireless communication.

Recently, the need for high data rate applications in compact communication devices has pushed the envelope of antenna technologies. To achieve high data rate, transmission frequencies have steadily increased, thereby decreasing the wavelength of the radio frequency band. For example, mobile devices operating in the millimeter wavelength range (30 to 300 GHz bandwidth) are capable of transferring data in the multi-gigabit-per-second range. One advantage of the smaller wavelength is that the size of the antenna may be decreased, thereby permitting communicating devices to become smaller and more compact. However, one disadvantage of the smaller wavelength is the higher propagation loss in the interconnections between the antenna and the transceiver, which directly affects communication performance. For example, increase in the interconnection length between the antenna and transceiver reduces the communication range of the wireless device. As such, an on-chip antenna (i.e. an antenna integrated on the same semiconductor substrate as the transceiver) is the optimal solution for communication devices operating in the millimeter wavelength range.

There have been attempts to develop on-chip antennas. However, because standard silicon substrate such as Complementary Metal Oxide Semiconductor (CMOS) and Silicon-Germanium (SiGe) are incompatible with antenna substrate requirements (i.e. low resistivity of CMOS and SiGe), on-chip antennas have often been inefficient and impractical for real world use. While techniques such as micro machining to remove the low resistivity substrate under the antenna and on-chip dielectric resonator antenna have been proposed to increase the efficiency of the on-chip antenna, fabrication complexity, cost and packaging issues have prevented such techniques from being used widely.

Off-chip antennas such as horn and lens antennas overcome the efficiency issues faced by on-chip antennas; however, they are expensive and are too bulky to be integrated into mobile communication devices.

Therefore, there is a need for a low-cost and highly efficient antenna that can be integrated into the transceiver.

SUMMARY

According to an embodiment of the present technology, an antenna is disclosed. The antenna comprises a first dielectric substrate and a second dielectric substrate disposed on the first dielectric substrate, the first dielectric substrate having relative permittivity greater than or equal to the second dielectric substrate. The antenna further comprises a microstrip line formed in the second dielectric substrate and a metal layer formed in the second dielectric substrate, the metal layer having a slot and being positioned between the microstrip line and the first dielectric substrate According to another embodiment of the present technology, a transceiver for a communication system is disclosed. The transceiver includes an antenna and a radiofrequency (RF) module coupled to a microstrip line of the antenna. The antenna comprises a first dielectric substrate and a second dielectric substrate disposed on the first dielectric substrate, the first dielectric substrate having relative permittivity greater than or equal to the second dielectric substrate. The antenna further comprises a microstrip line formed in the second dielectric substrate and a metal layer formed in the second dielectric substrate, the metal layer having a slot and being positioned between the microstrip line and the first dielectric substrate.

According to a further embodiment of the present technology, a microstrip-fed slot antenna comprising at least two dielectric substrates is disclosed. The first of the at least two dielectric substrates has relative permittivity greater than or equal to the second of the at least two dielectric substrates, and the second of the at least two dielectric substrates has a microstrip line and a metal layer connected to ground, the metal layer having at least one slot for radiating power coupled from the microstrip line.

In some embodiments, the metal layer has an array of slots.

In some embodiments, the metal layer abuts the first dielectric substrate.

In some embodiments, the antenna further includes a third dielectric substrate disposed on the second dielectric substrate.

In some embodiments, the antenna further includes solder balls deposited on the second dielectric substrate.

In some embodiments, the first dielectric substrate is a high-resistive silicon.

In some embodiments, the second dielectric substrate is silicon dioxide.

In some embodiments, the microstrip line is formed over the slot.

In some embodiment, the RF modules is bonded to the antenna using flip-chip bonding technique.

BRIEF DESCRIPTION OF THE DRAWINGS

These and other features of the technology will become more apparent from the following description in which reference is made to the appended drawings wherein.

DETAILED DESCRIPTION

Embodiments are described below, by way of example only, with reference to FIGS. 1-13.

The present disclosure relates to an antenna for use with wireless technologies. The antenna includes first and second dielectric substrates, with the first dielectric substrate having a relative permittivity greater than or equal to the second dielectric substrate. A microstrip line and a metal layer are formed in the second dielectric substrate, with the metal layer being positioned between the microstrip line and the first dielectric substrate. The metal layer further includes a slot through which a signal from a transceiver may be radiated. Thus, the microstrip line acts as the input and/or the output to the transceiver. When the microstrip line is the input, the antenna is used for transmitting a signal and when the microstrip line is the output to the transceiver, the antenna is used for receiving a signal.

In this specification and the appended claims, the singular forms "a," "an," and "the" include plural references unless the context clearly dictates otherwise. Unless defined otherwise, all technical and scientific terms used herein have the same meaning as commonly understood to one of ordinary skill in the art to which this disclosure belongs.

It will be further understood that the terms "comprises" or "comprising", or both when used in this specification, specify the presence of stated features, integers, steps, operations, elements, and/or components, but do not preclude the presence or addition of one or more other features, integers, steps, operations, elements, components, and/or groups thereof.

Figure 1:
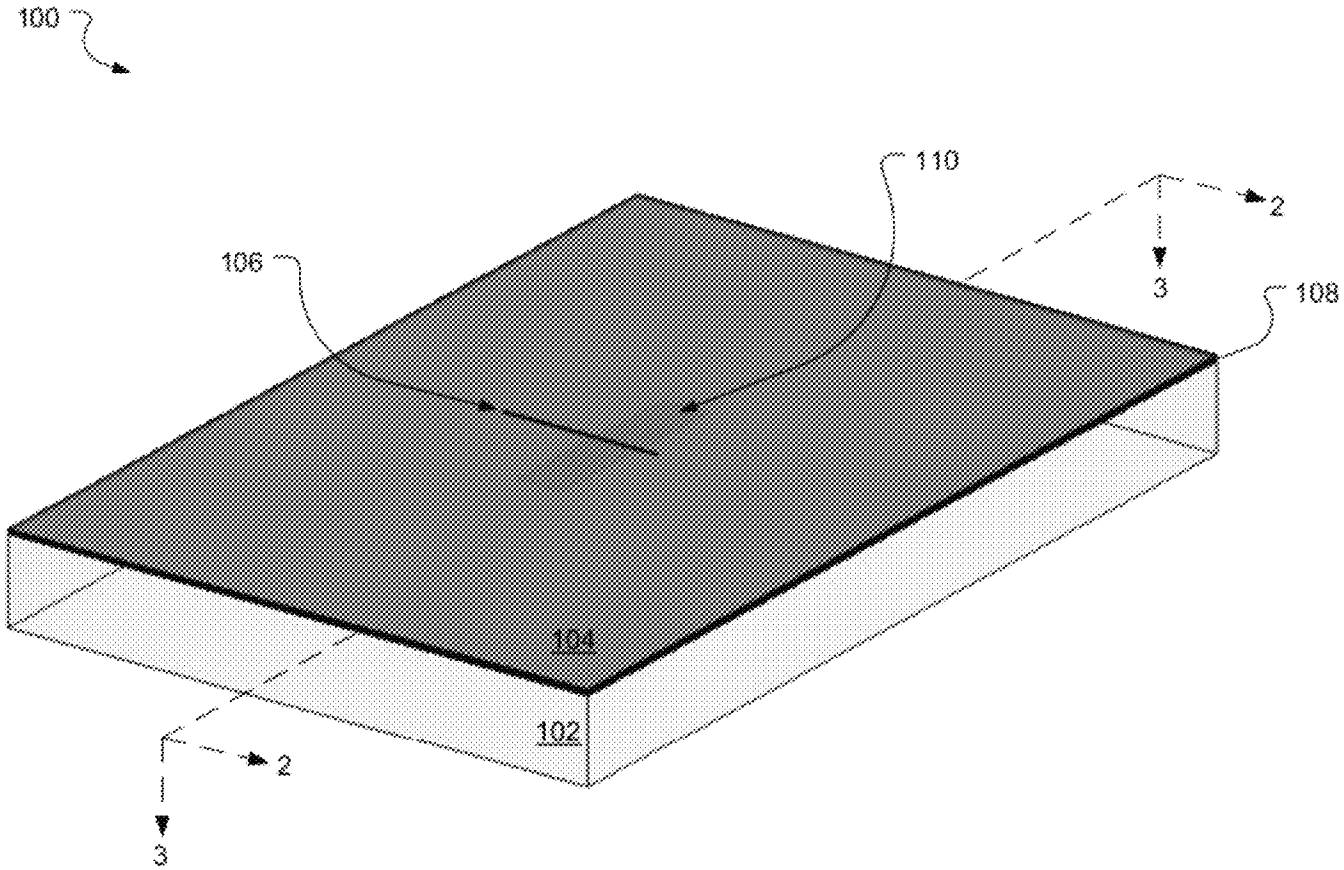
FIG. 1 shows a perspective view of an embodiment of the antenna as disclosed in the present disclosure.

A perspective view of an embodiment of the present technology is shown in FIG. 1. In this embodiment, the antenna 100 includes a first and second dielectric substrates 102 and 104. A microstrip line 106 is formed in the second dielectric substrate 104. The microstrip line 106 serves as the input/output to a transceiver (not shown) and it can be formed of a conductive material such as metal. Furthermore, the second dielectric substrate 104 has a metal layer 108 having a slot 110.

Figure 2:
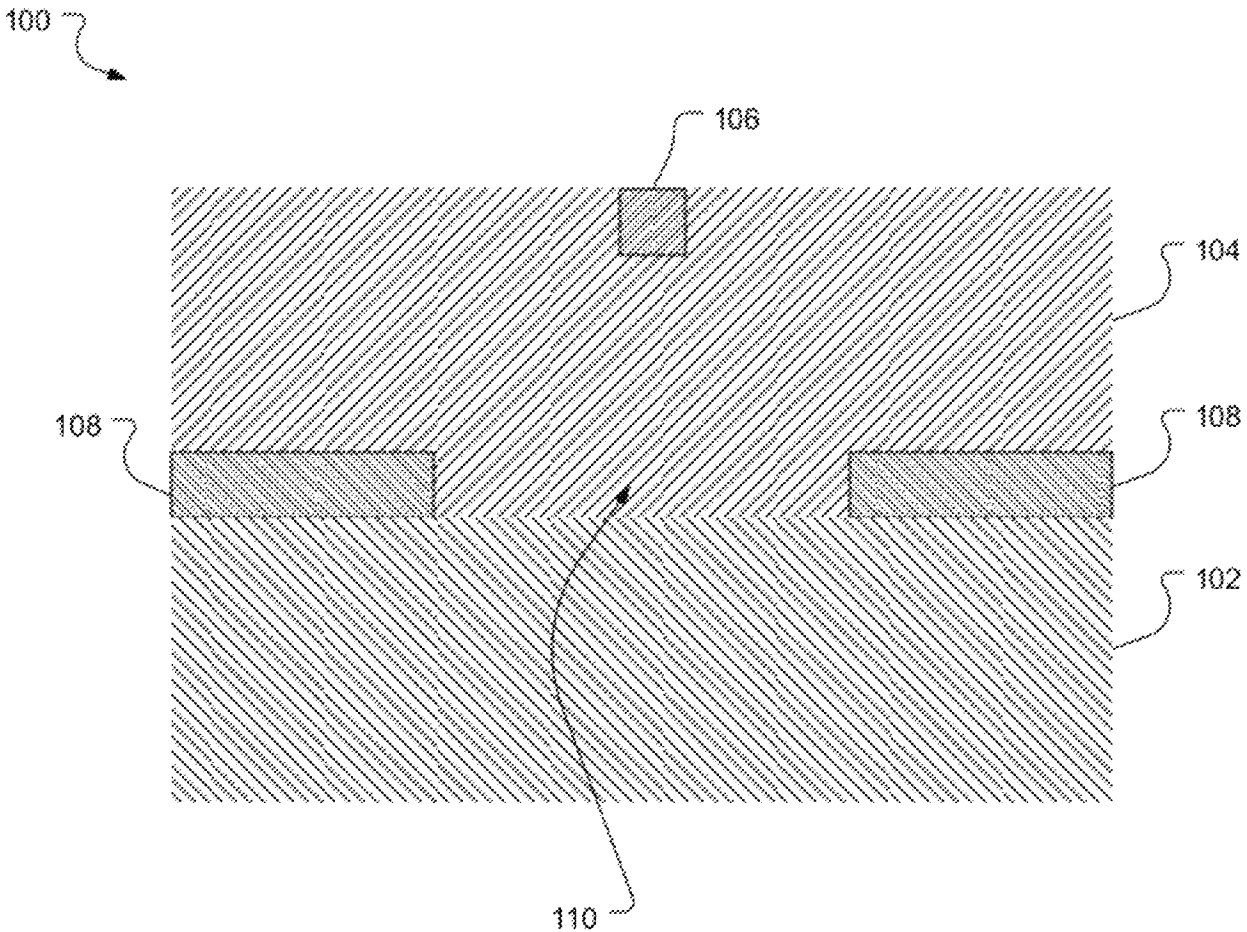
FIG. 2 shows a cross-sectional view of the embodiment of the antenna shown in FIG. 1 along the line 2-2.

Now turning to FIG. 2, a cross-sectional view along the line 2-2 of FIG. 1 is shown. The antenna 100 has a first dielectric substrate 102 and a second dielectric substrate 104 disposed on the first dielectric substrate 102. While this particular embodiment of the present technology has two dielectric substrates 102, 104, it will be understood that additional dielectric substrates may be included (see e.g. FIG. 7).

The antenna 100 further includes a microstrip line 106 and a metal layer 108, having a slot 110, formed in the second dielectric substrate 104. The microstrip line 106 serves as the input/output to the transceiver. When the microstrip line 106 serves as the input from the transceiver (i.e. antenna 100 used for transmission), the signal applied to the microstrip line 106 is coupled to the metal layer 108. This electric coupling occurs because the signal applied to the microstrip line 106 creates an electromagnetic field, which in turn induces a charge on the metal layer 108. Once the signal from the microstrip line is coupled, the slot 110 in the metal layer 108 starts to radiate in the free space through the first dielectric substrate 102 due to the magnetic current over the slot 110. Because the first dielectric substrate 102 is higher in relative permittivity than the second dielectric substrate 104, the slot 110 will radiate directionally toward the first dielectric substrate 102. Moreover, the high resistivity of the first dielectric substrate 102 helps with the radiation of the signal. The metal layer 108 also acts as the ground to the microstrip line 106.

When the antenna 100 is in an electromagnetic field, the microstrip line 106 acts as an output to the transceiver (i.e. antenna 100 used for reception). The electromagnetic field signal in the air is coupled to the metal layer 108, which is then captured by the microstrip line 106.

In the antenna 100 shown in FIG. 2, the metal layer 108 is shown to be formed at the intersection of the first and the second dielectric substrates 102, 104. In other words, the metal layer 108 abuts the first dielectric substrate 102. As described above, the first electric substrate 102 is higher in relative permittivity than the second dielectric substrate 104 and thus, the metal layer 108 abutting the first dielectric substrate 102 helps radiate the signal coupled from the microstrip line 106. However, while it is beneficial to have the metal layer 108 abut the first dielectric substrate 102, it will be understood that the metal layer 108 does not need to abut the first dielectric substrate 102 for the benefits of the present technology to be realized as it will be demonstrated below.

Figure 3:
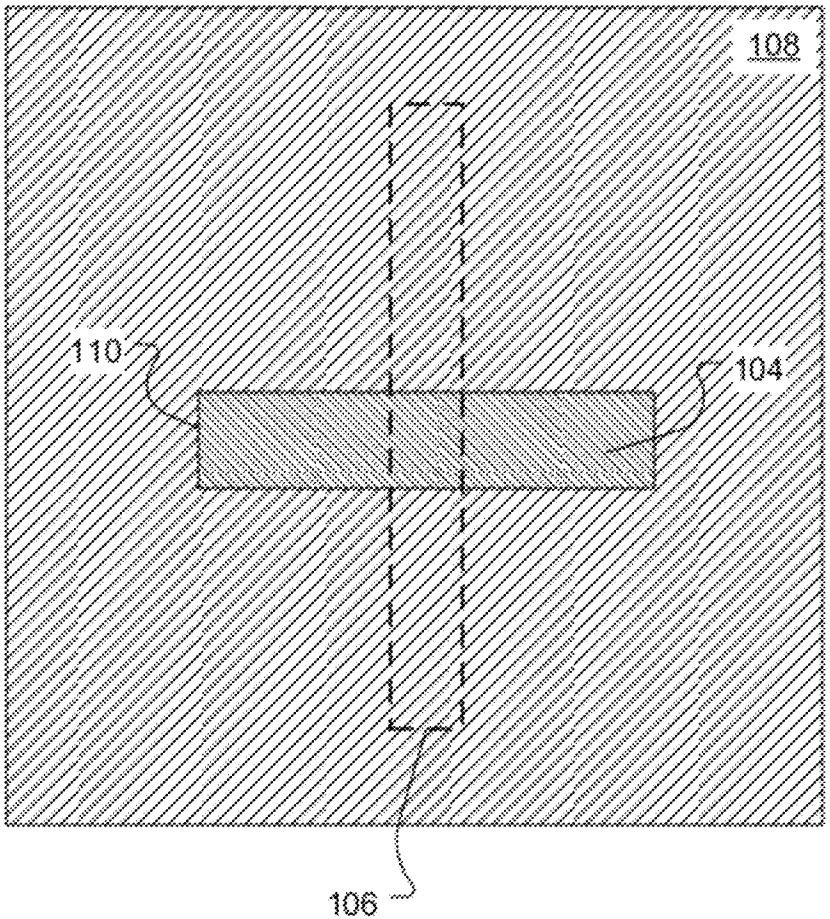
FIG. 3 shows a cross-sectional view of the embodiment of the antenna shown in FIG. 1 along the line 3-3 at the metal layer.

To help better describe the technology, a cross-sectional view along the line 3-3 at the metal layer 108 of FIG. 1 is shown in FIG. 3. The metal layer 108 includes a slot 110, which as shown in FIG. 3 is filled with the second dielectric substrate 104 since the metal layer 108 is formed in the second dielectric substrate 104. While in this particular embodiment, the metal layer 108 is shown to be the same dimension as the first dielectric substrate 102, it will be understood that the metal layer 108 may be other dimensions such as the metal layer 214 in FIG. 7.

FIG. 3 further shows the outline of the microstrip line 106, which is formed in the second dielectric substrate 104. The metal layer 108 is positioned such that the metal layer 108 is between the first dielectric substrate 102 and the microstrip line 106. Thus, when the microstrip line 106 is used as the output to the transceiver, the electromagnetic wave in the air is coupled into the metal layer 108, which is in turn captured by the microstrip line 106, and when the microstrip line 106 is used as the input from the transceiver, the signal from the transceiver is coupled to the metal layer 108 and radiated through the first dielectric substrate 106.

Figure 4:
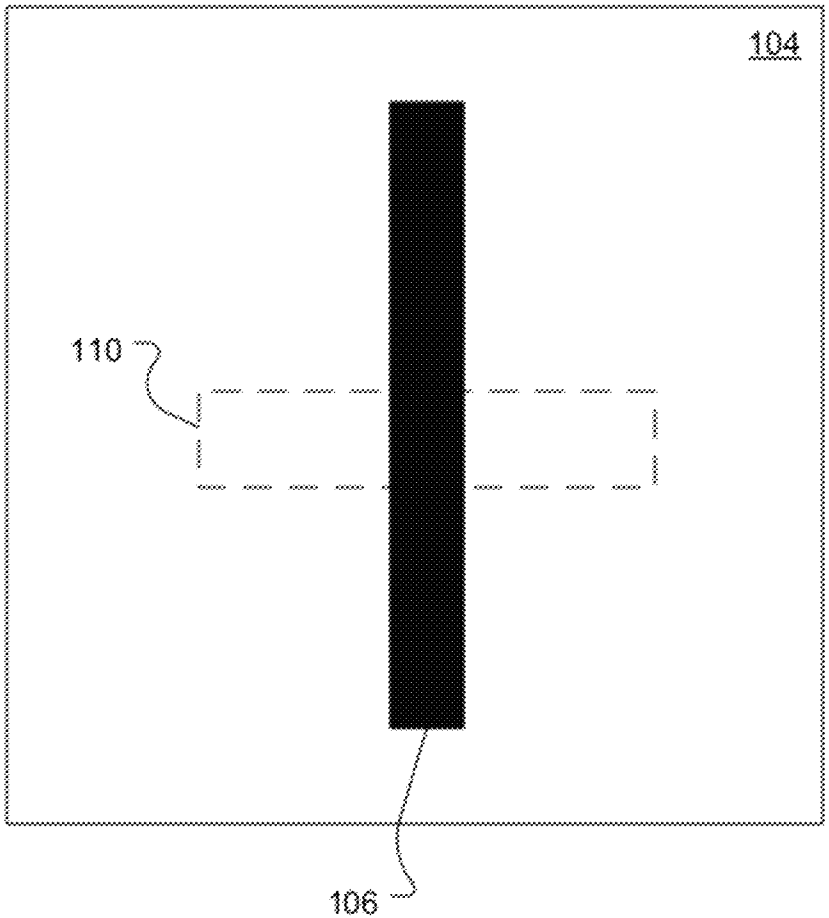
FIG. 4 shows a top view of the embodiment of the antenna shown in FIG. 1.
Figure 5:
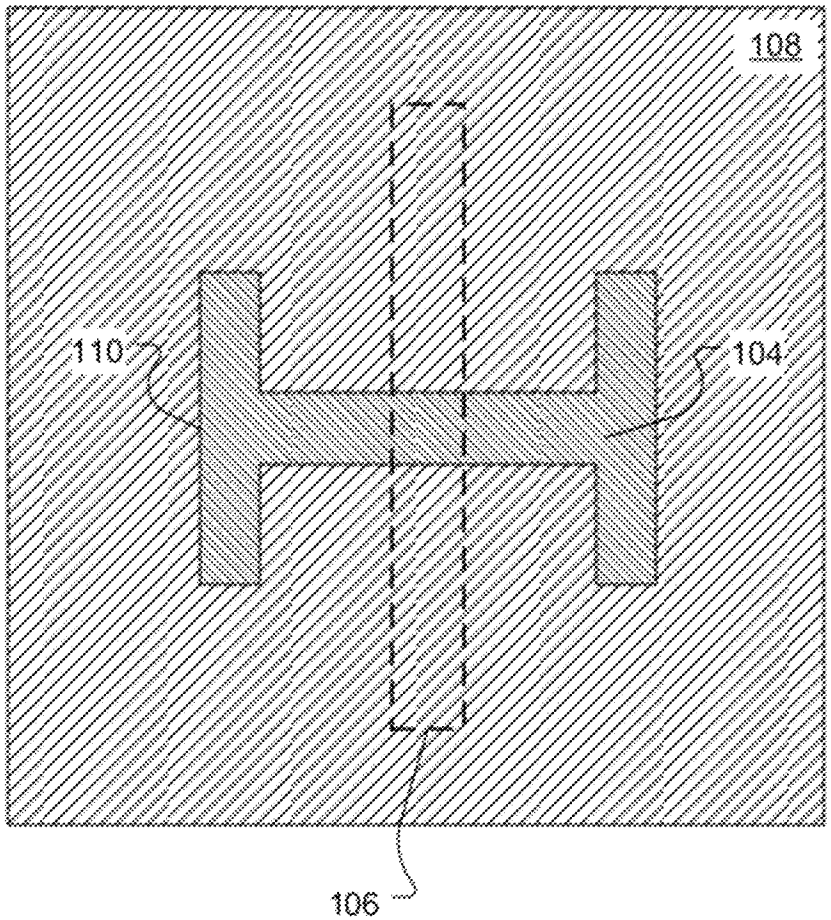
FIG. 5 shows a cross-sectional view of another embodiment of the antenna according to the present technology.

As a comparison, FIG. 4 shows the top view of the antenna 100 shown in FIG. 1. The dotted line shows the location of the slot 110, which is in the metal layer 108 located between the first dielectric substrate 102 and the microstrip line 106. Both the microstrip line 106 and the metal layer 108 are formed in the second dielectric substrate 104.

Figure 6:
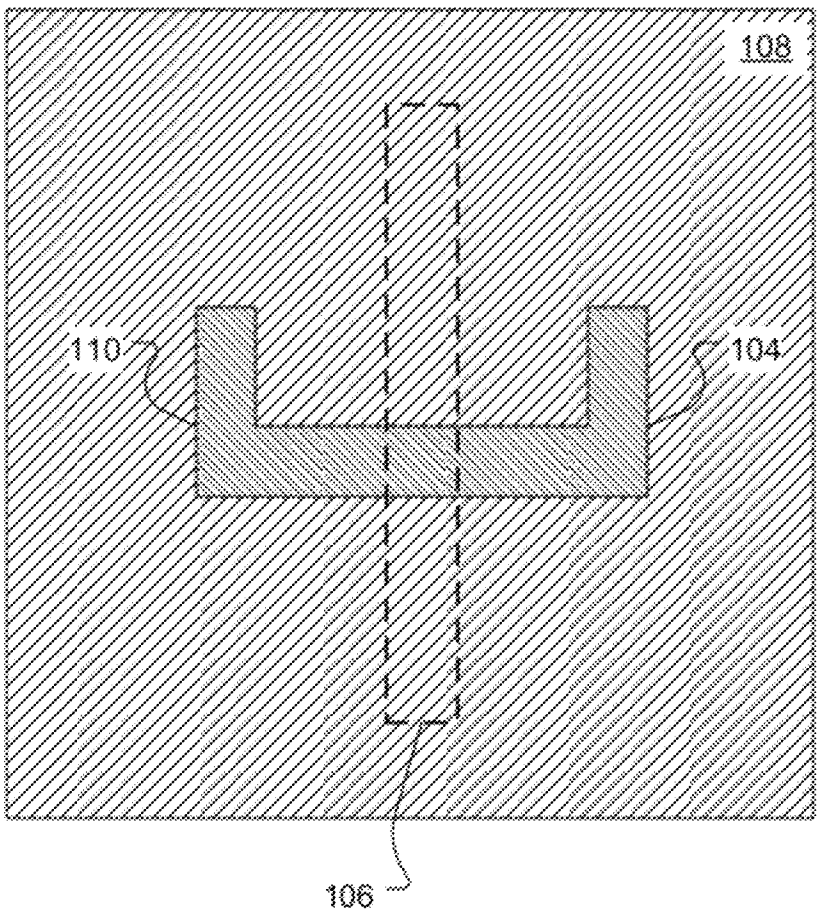
FIG. 6 shows a cross-sectional view of a further embodiment of the antenna according to the present technology.

While FIGS. 1-4 illustrate the slot 110 as being rectangular in shape, it will be understood that the slot 110 may take on other shapes. For example, in FIG. 5, the metal layer 108 is shown to incorporate an "H-shaped" slot 110. In a further embodiment, the slot 110 in the metal layer 108 may be generally "U-shaped" as shown in FIG. 6. As with the embodiments of the antenna 100 shown in FIGS. 1-4, the metal layer 108 is formed in the second dielectric substrate 104, along with the microstrip line 106.

Simulation Results

To test the performance, a microstrip-fed antenna was implemented in ON Semiconductor's Integrated Passive Device (IPD) technology. IPD technology provides a unique integrated platform for implementation of low loss, high quality and low profile passive radio frequency (RF) elements and components such as inductors, filters, baluns, and duplexers on silicon. This technology employs high resistivity silicon as the substrate as opposed to the low resistivity silicon substrates in CMOS and SiGe technologies.

The test antenna was designed and optimized to operate in the frequency range of 58 to 63 GHz with 3.5 dBi radiation gain. The entire size of the antenna was 2 mm×3 mm. Advantageously, the proposed antenna can be integrated with other active elements of the millimeter-wave systems in the same package as a flip-chip antenna die to obtain a fully integrated 60 GHz radio. While the test antenna was optimized and configured as mentioned, it is understood that the present technology is not limited to the specifics of the test antenna.

Figure 7:
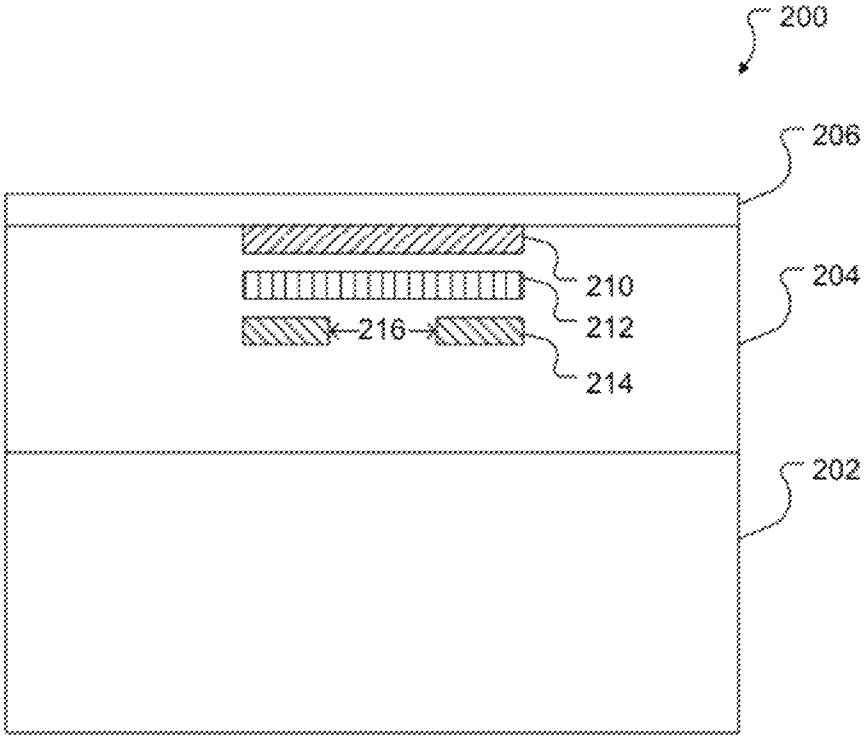
FIG. 7 shows a cross-sectional view of a test antenna as disclosed in the present disclosure.

FIG. 7 shows the cross-section of the test antenna 200 using ON Semiconductor Company's IPD technology. The test antenna 200 has first and second dielectric substrates 202, 204, where the first dielectric substrate 202 is higher in relative permittivity than the second dielectric substrate 204. In the test antenna 200, a third dielectric substrate 206 was disposed on the second dielectric substrate 204 to protect the metal layers (i.e. microstrip line 210, and metal layers 212, 214) from oxidation. In the second dielectric substrate 204, a microstrip line 210 and metal layer 214 having a slot 216 have been implemented. As described above, the microstrip line 210 serves as the input/output to a transceiver by electrically coupling a charge on the metal layer 214 or by capturing air borne signals electrically coupled to the metal layer 214. The test antenna 200 further includes a second metal layer 212 that may be part of the fabrication process and may be used to further vary the design of the antenna.

In this test antenna 200, it is to be noted that the metal layer 214 does not abut the first dielectric substrate 202 and is not the same in cross-sectional dimension as the first dielectric substrate 202. It will also be understood that the thickness of each dielectric substrate 202, 204 and 206 may be varied depending on the antenna design variations.

In the particular embodiment of the test antenna 200 shown in FIG. 7, the first dielectric substrate 202 was chosen to be a high-resistive silicon with a thickness of 280 μm, relative permittivity of $\in_r$=11.9 and conductivity of σ=0.1 S/m. The second dielectric substrate 204 was chosen to be $SiO_2$ with a thickness of 14 μm. Moreover, the thickness of the microstrip line 210 and the metal layer 214 were 5 μm and 2 μm, respectively. To set the impedance of the microstrip line 210 to 50Ω, the width of the microstrip line 210 was chosen to be 8 μm.

With the chosen parameters, the optimized slot 216 was calculated. The length of the slot 216 is $\lambda_g/2$; where $$\lambda_g = \frac{c}{f\sqrt{\varepsilon_{eff}}}.$$

The slot 216 is over the first dielectric substrate 204, which is a silicon with $\in_r$=12; therefore $\in_{eff} \approx \in_r$ and $\lambda_g \approx 1.45$ mm at the operating frequency of 58 GHz to 63 GHz. The optimized dimension of the slot 216 was then calculated to be 700 μm×150 μm. While the parameters of the test antenna 200 were chosen as mentioned, it will be understood that other parameters are possible depending on the desired characteristics or required specifications of the antenna.

Figure 8:
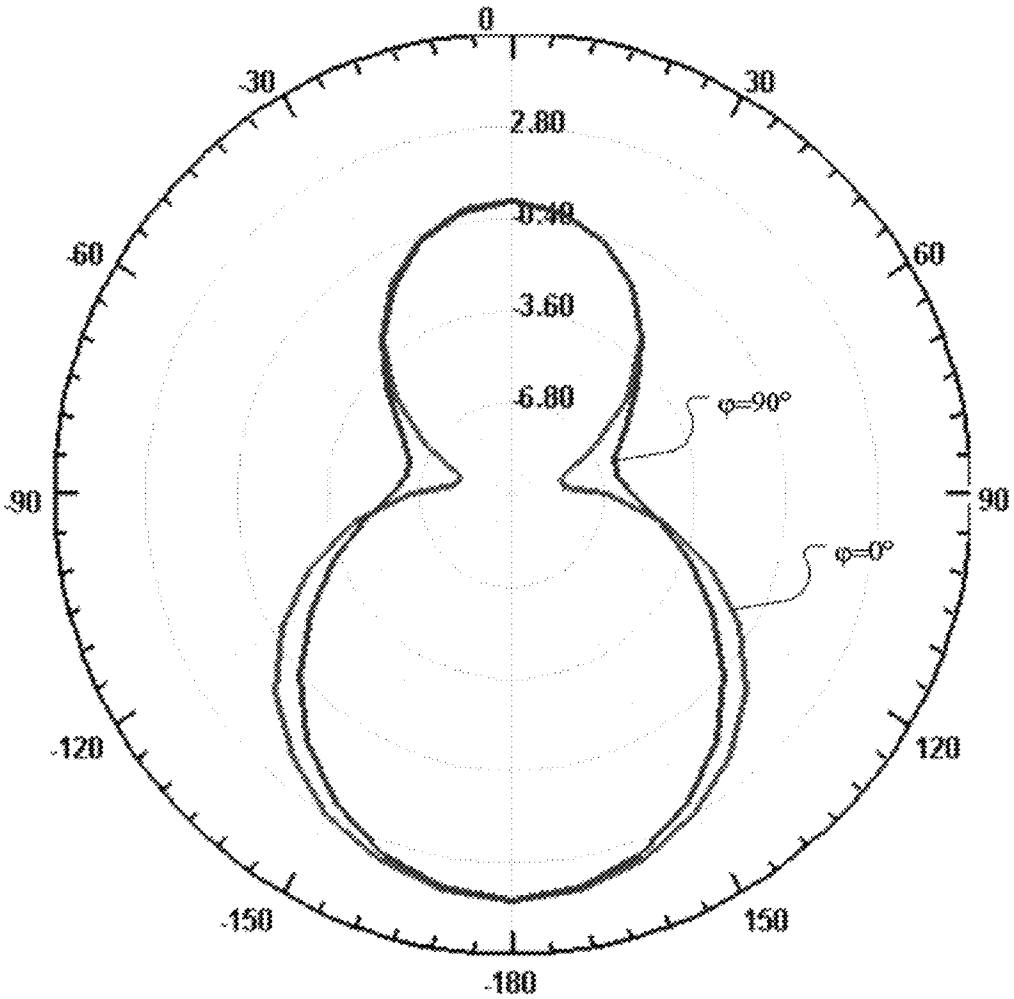
FIG. 8 shows a simulated radiation pattern of the test antenna as shown in FIG. 7.

The gain pattern of the test antenna 200 at ϕ=0° (i.e. XZ plane) and ϕ=90° (i.e. YZ plane) is shown in FIG. 8, where ϕ is the azimuth angle of the orthogonal projection of observation point on a reference plane that passes through the origin and is orthogonal to the zenith, measured from a fixed reference direction on that plane. As shown, the maximum gain of the antenna is along θ=180° since the first dielectric substrate 202 having the higher relative permittivity is located at the bottom the antenna 200. The simulation shows that the maximum gain of the antenna 200 is 3.5 dBi and the beam width of the antenna is 90° and 100° at ϕ=0° and ϕ=90°, respectively.

Figure 9:
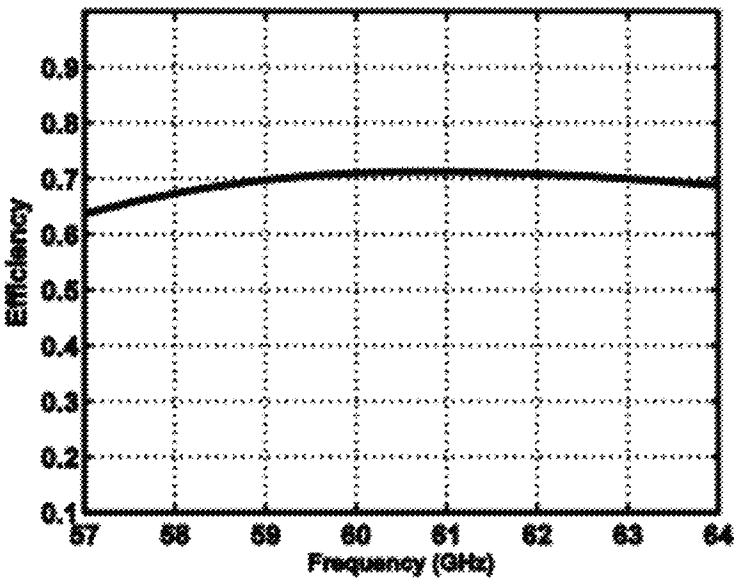
FIG. 9 shows a simulated input reflection coefficient and efficiency of the test antenna as shown in FIG. 7.
Figure 9:
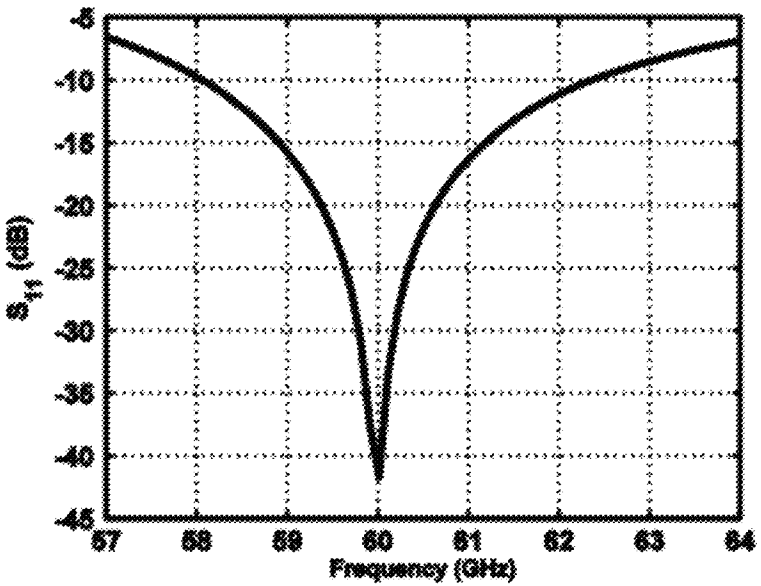

Now turning to FIG. 9, $S_{11}$ (input reflection coefficient) and the efficiency of the antenna 200 are shown. The Ansoft™ HFSS simulations show that the structure has a resonance at 60 GHz. The antenna shows return loss of better than 10 dB over the frequency band 58-62.5 GHz. Theoretically, the gain of a slot 216 which is radiating in free space is 1.5 dBi. In the test antenna 200, it is shown that the high-resistivity silicon can improve the gain of the single slot antenna 200 by 2 dBi. The efficiency of the antenna is better than 64% over the aforementioned range of frequency while the radiation efficiency is 72% at 60 GHz.

Antenna with Array of Slots

Figure 10:
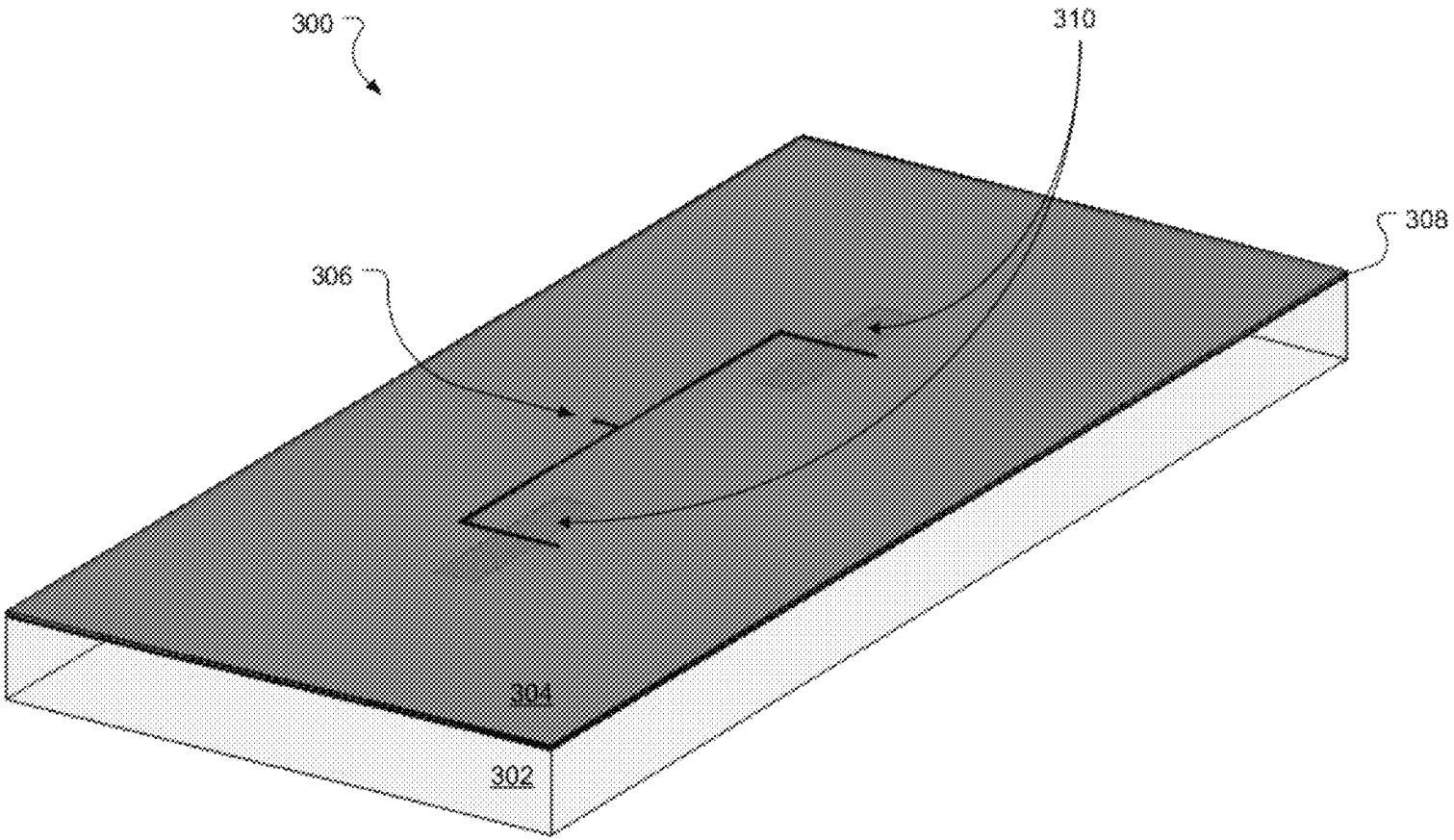
FIG. 10 shows a perspective view of another embodiment of the antenna having two slots.

The amount of gain in the antenna may be increased by using an array of slots. As shown in FIG. 10, the antenna 300 has two slots 310. While the antenna 300 in FIG. 10 is shown with two slots 310, any reasonable number of slots may be used.

Similarly to the single slot antenna (e.g. antenna 100 in FIG. 1), the antenna 300 has a first and second dielectric substrate 302, 304. The metal layer 308 is formed in the second dielectric substrate 304. In this embodiment, two slots 310 have been implemented in the metal layer 308. Also, the second dielectric substrate 304 includes a microstrip line 306 designed to be directly over both the slots 310. The design variations applicable to the single slot antenna are also applicable to antenna with array of slots.

Figure 11:
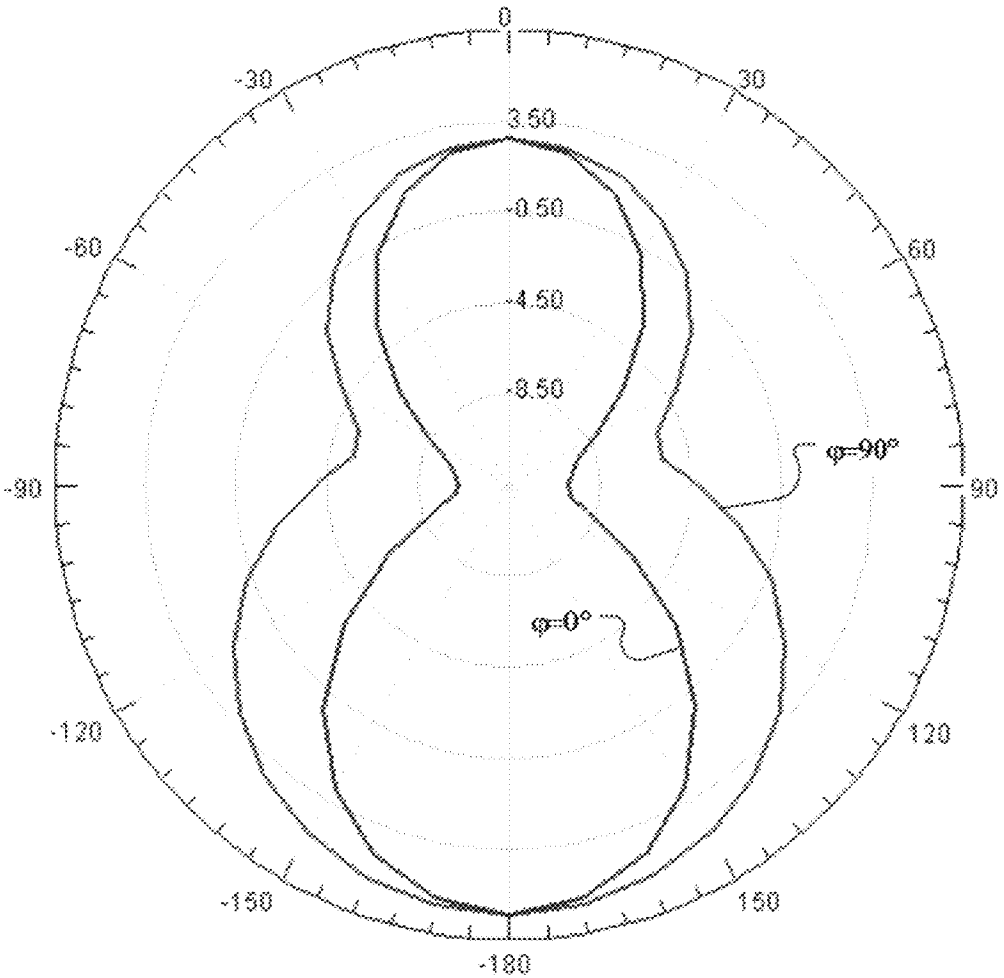
FIG. 11 shows a simulated radiation pattern of the antenna as shown in FIG. 10.
Figure 12:
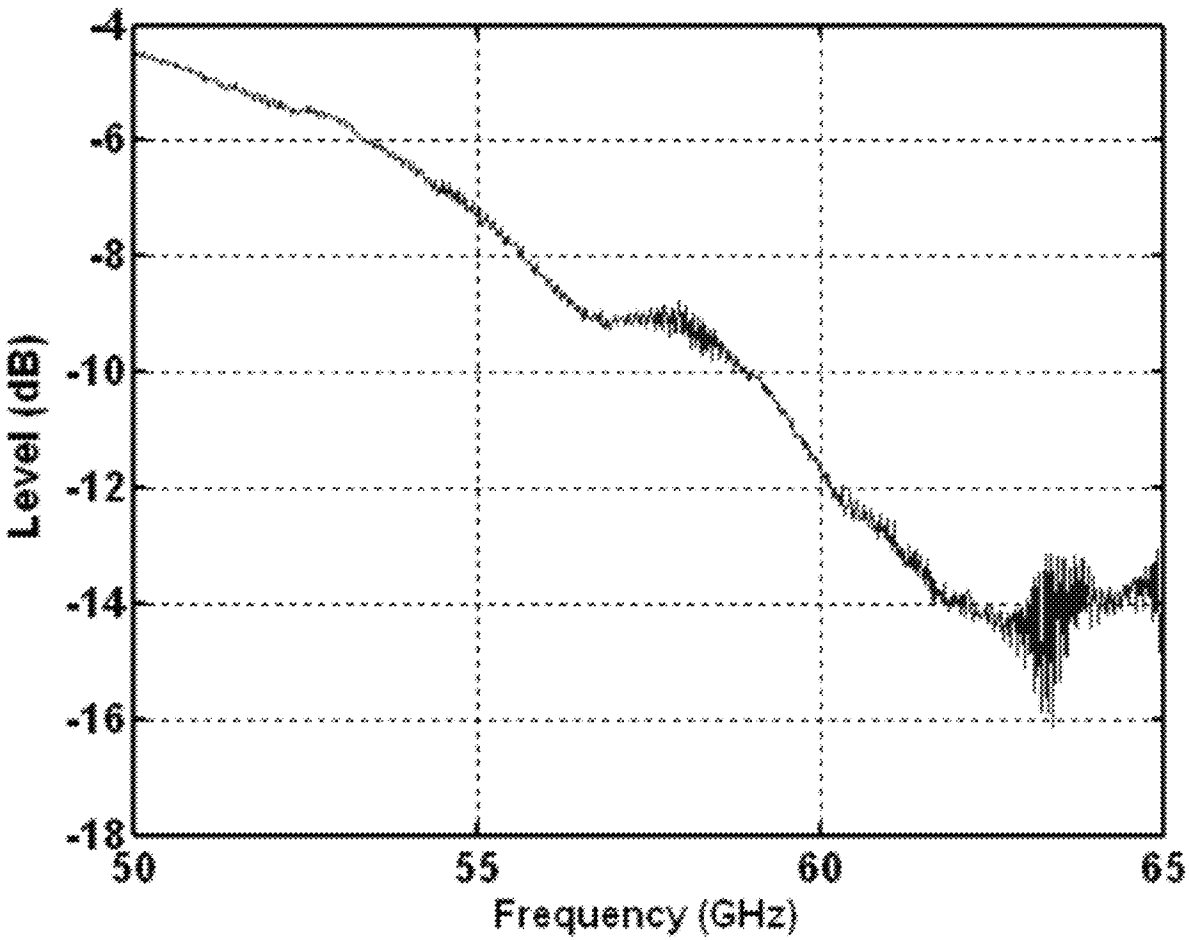
FIG. 12 shows a simulated input reference pattern of the antenna as shown in FIG. 10.

As stated above, the test antenna 200 with a single slot 216 produced a radiation gain of about 3.5 dBi. For the simulated dual slot antenna 300, the simulated gain was more than 6 dBi as shown in FIG. 11. As for the $S_{11}$ of antenna 300, FIG. 12 shows that the return loss of antenna 300 is better than 10 dB over a frequency of more than 6 GHz.

Packaging

Figure 13:
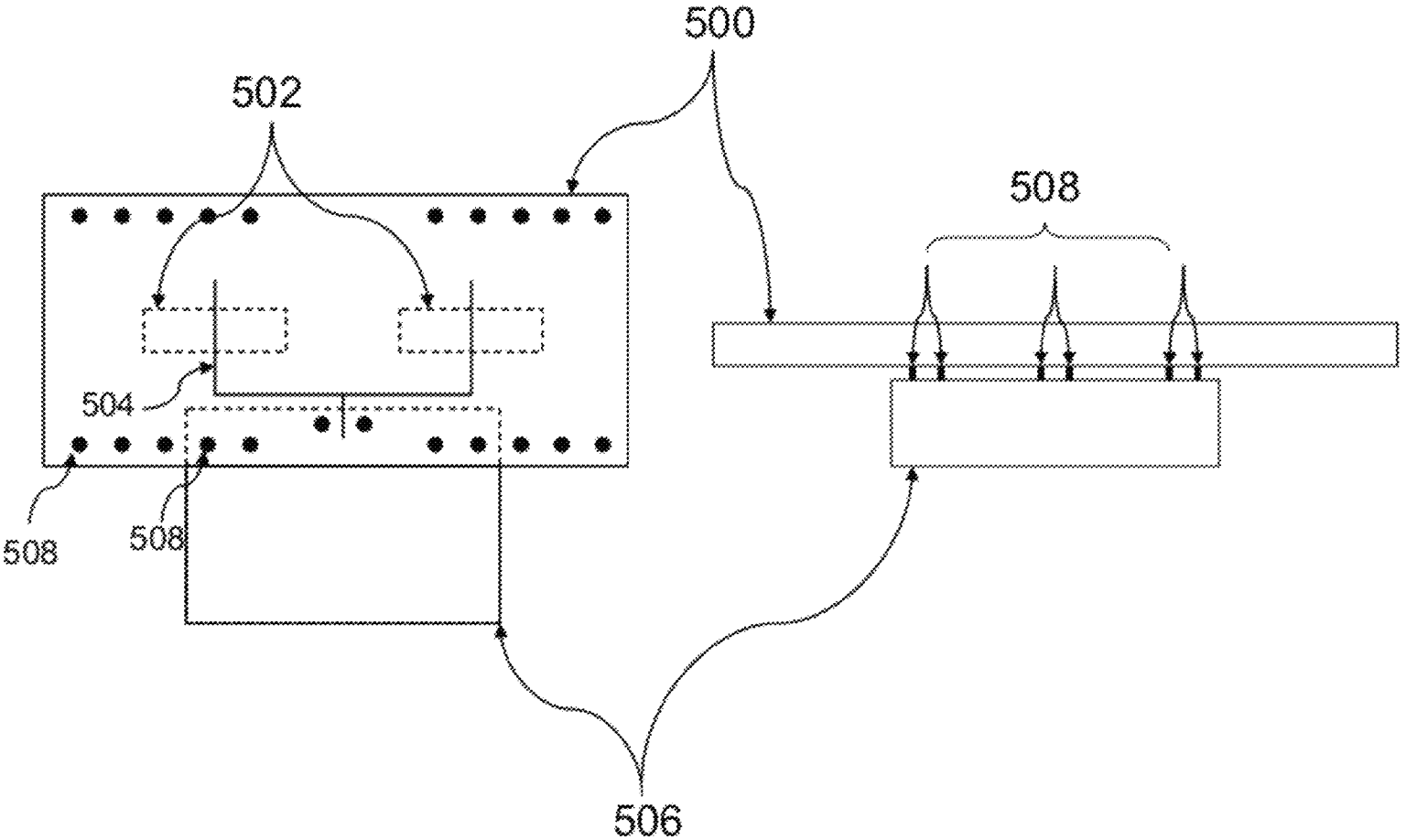
FIG. 13 shows the antenna according to the embodiment shown in FIG. 10 integrated with an RF front-end chip.

One of the advantages of this antenna is the packaging capabilities. Because of the small size of the antenna, the antenna can be fully integrated within the transceiver. For example, referring to FIG. 13, the antenna 500 may be deposited with solder balls 508. The antenna 500 shown in FIG. 13 has dual slots 502 with microstrip line 504 created directly over the dual slots 502. The antenna can then be connected to an RF front-end chip 506 through flip-chip bonding techniques. Simulation shows that the radiation efficiency of the entire package, as shown in FIG. 13, is more than 85% including the loss of the interconnections 508. While FIG. 13 illustrates an antenna with dual slots, it will be understood that the packaging capabilities discussed in this section is applicable to other variations of the antenna as discussed above.

While the present technology has been described in terms of specific implementations and configurations, further modifications, variations, modifications and refinements may be made without departing from the inventive concepts presented herein. The scope of the exclusive right sought by the Applicants is therefore intended to be limited solely by the appended claims.

What is claimed is:

1. An antenna comprising:

a first dielectric substrate;

a second dielectric substrate disposed on the first dielectric substrate, wherein the second dielectric substrate is silicon dioxide, and wherein the first dielectric substrate has a relative permittivity greater than the second dielectric substrate;

a micro strip line formed in the second dielectric substrate; and a metal layer formed in the second dielectric substrate, the metal layer having a slot and being positioned between the microstrip line and the first dielectric substrate, and wherein the metal layer is electrically coupled to ground;

wherein the first dielectric substrate contacts the second dielectric substrate.

2. The antenna according to claim 1, wherein the metal layer has an array of slots.

3. The antenna according to claim 1, wherein the metal layer abuts the first dielectric substrate.

4. The antenna according to claim 1, further comprising a third dielectric substrate disposed on the second dielectric substrate.

5. The antenna according to claim 1, further comprising solder balls deposited on the second dielectric substrate.

6. The antenna according to claim 1, wherein the first dielectric substrate is a high-resistive silicon.

7. The antenna according to claim 1, wherein the microstrip line is formed over the slot.

8. A transceiver for a communication system, the transceiver comprising:

an antenna comprising:

a first dielectric substrate;

a second dielectric substrate disposed on the first dielectric substrate, the first dielectric substrate having relative permittivity greater than or equal to the second dielectric substrate;

a micro strip line formed in the second dielectric substrate; and a metal layer formed in the second dielectric substrate, the metal layer having a slot and being positioned between the microstrip line and the first dielectric substrate, wherein the first dielectric substrate contacts the second dielectric substrate; and a semiconductor substrate comprising a radiofrequency (RF) module, wherein the antenna is integrally attached to the semiconductor substrate using flip-chip bonding technique, and wherein the radiofrequency module is operatively coupled to the micro strip line in the antenna.

9. The transceiver according to claim 8, wherein the metal layer has an array of slots.

10. The transceiver according to claim 8, wherein the metal layer abuts the first dielectric substrate.

11. The transceiver according to claim 8, wherein the antenna further comprises a third dielectric substrate disposed on the second dielectric substrate.

12. The transceiver according to claim 8, wherein the first dielectric substrate is a high-resistive silicon.

13. The transceiver according to claim 8, wherein the second dielectric substrate is silicon dioxide.

14. The transceiver according to claim 8, wherein the microstrip line is formed over the at least one slot.

15. The antenna according to claim 1, wherein the second dielectric substrate extends through the slot in the metal layer to contact the first dielectric substrate.

16. The antenna according to claim 1, wherein the metal layer is spaced apart from the first dielectric layer.

17. A transceiver for a communication system, the transceiver comprising:

an antenna comprising:

a first dielectric substrate;

a second dielectric substrate disposed on the first dielectric substrate, wherein the first dielectric substrate has a relative permittivity greater than the second dielectric substrate, and wherein the first dielectric substrate contacts the second dielectric substrate;

a third dielectric substrate disposed on the second dielectric substrate;

a micro strip line formed in the second dielectric substrate; and a first metal layer formed in the second dielectric substrate and spaced apart from the first dielectric substrate, the first metal layer having a slot and being positioned between the microstrip line and the first dielectric substrate, a second metal layer formed in the second dielectric substrate, wherein the second metal layer is positioned between the microstrip line and the first metal layer; and a semiconductor substrate comprising a radiofrequency (RF) module, wherein the antenna is integrally attached to the semiconductor substrate using flip-chip bonding technique, and wherein the radiofrequency module is operatively coupled to the microstrip line on the antenna.

18. The transceiver according to claim 17, wherein the first dielectric substrate is a high-resistive silicon, and wherein the second dielectric substrate is silicon dioxide.

19. The transceiver according to claim 8, wherein the microstrip line extends in a direction substantially orthogonal to a major axis of the slot in metal layer.

20. The transceiver according to claim 8, where the second dielectric substrate is silicon dioxide.

* * * * *